US006216803B1

(12) United States Patent
Deken

(10) Patent No.: US 6,216,803 B1
(45) Date of Patent: Apr. 17, 2001

(54) ANCHOR ASSEMBLY

(75) Inventor: Arthur D. Deken, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 09/338,077

(22) Filed: Jun. 23, 1999

(51) Int. Cl.[7] ..... E21B 19/08

(52) U.S. Cl. ..... 175/162; 173/188; 52/157; 52/158

(58) Field of Search ..... 175/203, 162, 175/323, 292, 394; 173/184, 185, 186, 187, 188, 31; 52/155, 156, 157, 158, 159, 160, 161, 166

(56) References Cited

U.S. PATENT DOCUMENTS

| | | | | |
|---|---|---|---|---|
| 505,811 | | 10/1893 | Brown . | |
| 756,640 | | 4/1904 | Irons . | |
| 911,504 | | 2/1909 | Jay . | |
| 2,660,276 | | 11/1953 | McKee | 189/92 |
| 2,899,029 | | 8/1959 | Ballew | 189/92 |
| 3,032,128 | | 5/1962 | Walton | 175/292 |
| 3,422,629 | | 1/1969 | Watts | 61/53.52 |
| 3,508,622 | | 4/1970 | Benetti et al. | 175/292 |
| 3,734,214 | | 5/1973 | Benetti et al. | 175/326 |
| 3,752,242 | * | 8/1973 | Gremillion | 175/108 |
| 3,830,315 | * | 8/1974 | Love | 173/26 |
| 3,864,923 | | 2/1975 | Turzillo | 61/53.6 |
| 3,952,523 | * | 4/1976 | Gale | 61/39 |
| 3,961,671 | * | 6/1976 | Adams et al. | 173/1 |
| 3,973,409 | * | 8/1976 | Asayama | 61/39 |
| 4,036,026 | | 7/1977 | Asayama | 61/56.5 |
| 4,060,994 | | 12/1977 | Chitis | 61/53.6 |
| 4,189,879 | * | 2/1980 | Patterson | 52/161 |
| 4,193,462 | | 3/1980 | Blaschke et al. | 175/292 |
| 4,248,313 | * | 2/1981 | Bonca | 175/239 |
| 4,251,963 | * | 2/1981 | Patterson | 52/157 |
| 4,882,891 | * | 11/1989 | Sero et al. | 52/742 |
| 5,145,286 | * | 9/1992 | Summers | 405/258 |
| 5,150,549 | * | 9/1992 | Chen | 52/162 |
| 5,203,127 | * | 4/1993 | Olthoff et al. | 52/161 |
| 5,476,149 | | 12/1995 | Rickards | 175/388 |
| 5,660,504 | * | 8/1997 | Reinert, Sr. | 405/232 |
| 5,709,276 | * | 1/1998 | Lee | 175/122 |
| 5,797,704 | | 8/1998 | Collins | 405/237 |
| 5,811,741 | * | 9/1998 | Coast et al. | 181/101 |
| 5,944,452 | * | 8/1999 | Reinert, Sr. | 405/232 |

* cited by examiner

*Primary Examiner*—Victor Batson
(74) *Attorney, Agent, or Firm*—McKinney & Stringer, P.C.

(57) ABSTRACT

An anchor assembly for securing a boring machine to the earth is provided. The anchor assembly includes a shaft equipped with a helical assembly by which the shaft can be driven into and removed from the earth like a screw. The helical assembly preferably includes a plurality of flights and a plurality of wings pivotally attached to the flights and helically aligned therewith. The wings and flights are configured so that rotation in one direction urges the wings into the retracted position. However, counter-rotation for only part of a turn forces the wings into the extended position, which expands the diameter of the helical assembly. Thus, the extended wings bite into soil that was undisturbed during the initial insertion, providing increased frictional engagement between the anchor and the soil. Yet, because the wings are helically aligned with the flights, the extended wings do not substantially resist withdrawal of the anchor assembly from soil by reverse rotation. The anchor assembly includes a cap assembly with a cylindrical skirt that engages the surface of the earth around the anchor insertion point. A lock nut presses the skirt into the ground clamping the soil between the plate and the helical assembly giving even greater strength to the engagement between the anchor assembly and the earth. The large vertical surface area provided by the skirt, in conjunction with the "ground-clamping" action of the cap assembly, aids in restricting lateral movement of the boring machine and resisting premature displacement of the anchors.

47 Claims, 8 Drawing Sheets

ANCHOR ASSEMBLY

FIELD OF THE INVENTION

The present invention relates generally to an anchor assembly for securing an object to a compressible material, and more particularly to an anchor assembly for securing a boring machine to the earth adjacent the boring site.

SUMMARY OF THE INVENTION

The present invention is directed to an anchor assembly for securing an object to a compressible material. The anchor assembly comprises a shaft having an upper and a lower portion and a helical assembly on the lower portion of the shaft. The helical assembly comprises a helical flight that renders the lower portion insertable into the compressible material by rotating the shaft in a first direction and axially advancing the shaft. The lower portion of the shaft is also thereby rendered removable from the compressible material by rotating the shaft in a second direction opposite the first direction and axially withdrawing the shaft. The helical assembly also includes a wing supported adjacent the lower portion of the shaft and movable between an extended position and a retracted position. The wing is helically aligned with the helical flight in both the extended position and the retracted position. The wing is connected so that, as the shaft is inserted into the compressible material, the wing is urged toward the retracted position. Likewise, as the shaft is rotated in the second direction, the wing is urged toward the extended position thereby expanding the outer diameter of the helical assembly.

Further, the present invention is directed to a boring machine comprising a frame and some means for advancing a drill string from the frame to form a borehole in the earth. The boring machine is equipped with the anchor assembly described above.

BRIEF DESCRIPTION OF THE DRAWINGS

FIG. 8 shows a plan view of the hub of FIG. 2 with the wings in the retracted position.

FIG. 9 shows a plan view of the hub of FIG. 2 with the wings in the extended position.

BACKGROUND OF THE INVENTION

Horizontal boring machines are used in industry to tunnel boreholes underground usually for the installation of utilities. Typically, the boring machine is secured to the earth at the bore site by connecting the machine to anchors embedded in the earth. High thrust and torque pressures combined with varying soil conditions may loosen the grip of the anchors in the soil. Thus, there remains a continuing need to improve these "earth anchors" to provide increased resistance to dislodgement in response to forces of the drill string and the boring machine. This will reduce the instances where interruption of the boring operation is required to reset a loosened anchor.

DETAILED DESCRIPTION OF THE PREFERRED EMBODIMENTS

The present invention provides an improved anchor assembly that combines enhanced threaded engagement with a clamping assembly. The threaded engagement of the helical assembly with the earth is enhanced by expandable wings that engage undisturbed soil after the anchor is completely embedded. Then, a cap assembly at the surface clamps or compresses the soil between the embedded, expanded helical assembly and the front of the boring machine, which augments the gripping force of the expanded helical assembly. In addition, this arrangement enhances lateral stability of machine. The helical configuration facilitates insertion and removal of the anchor by rotation and counter-rotation. These and other advantages of the present invention will be apparent from the following description of the preferred embodiments.

Figure 1:
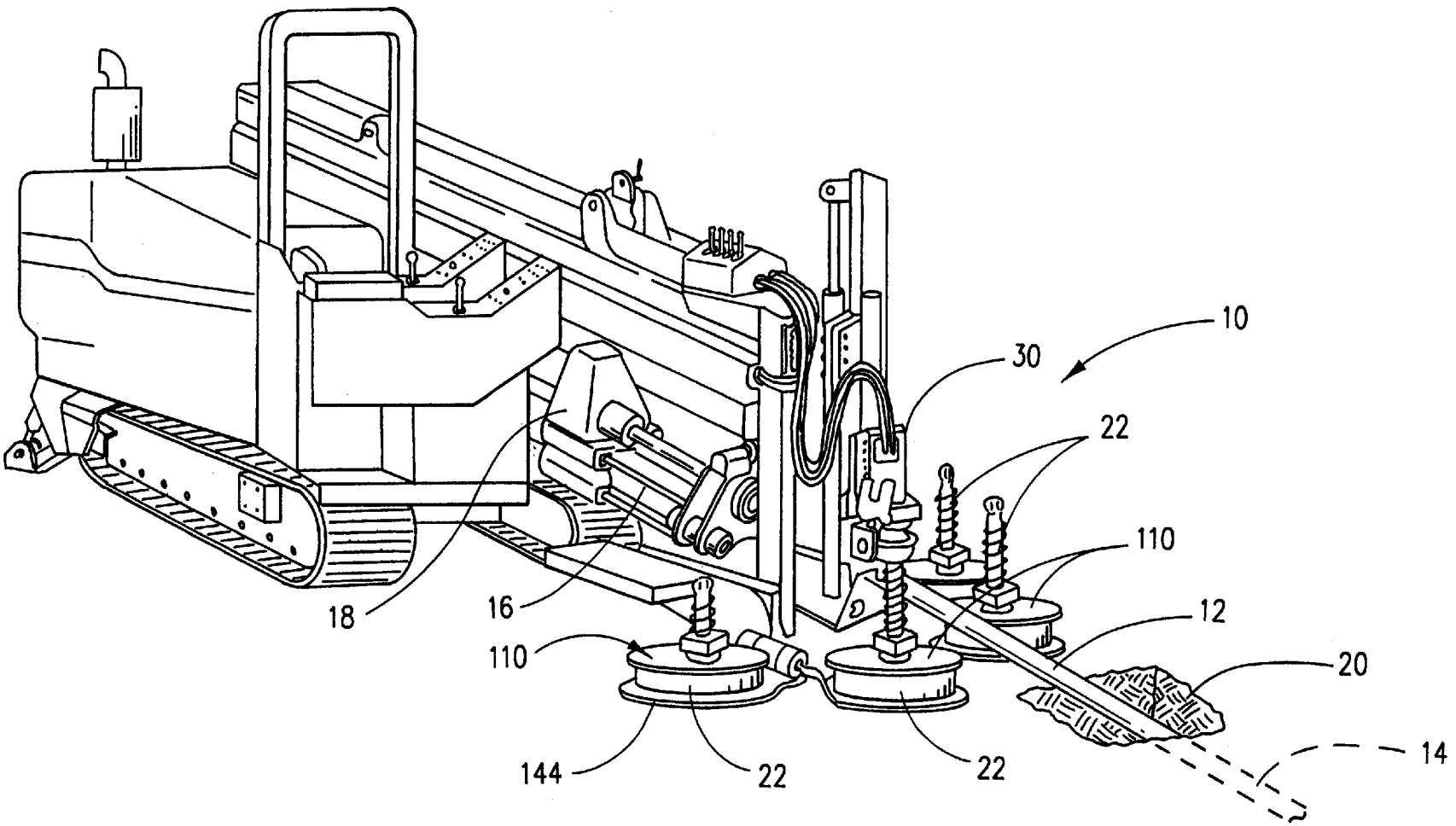
FIG. 1 is a perspective view of a boring machine anchored in the earth using anchor assemblies in accordance with the present invention.

Turning now to the drawings in general, and to FIG. 1 in particular, shown therein is a boring machine constructed in accordance with the present invention and designated generally by the reference numeral 10. The boring machine 10 is adapted to advance a drill string 12 horizontally underground to form a borehole 14 for the purpose of installing utility lines and the like. The drill string 12 usually comprises a plurality of drill pipes joined end to end in sequential fashion while the machine 10 advances the string. Once the borehole 14 is completed, the drill string 12 is withdrawn and disassembled pipe by pipe. However, it will be understood that for the purposes of the present invention a drill string of continuous tubular material may be used.

The boring machine 10 generally comprises a frame 16 which supports a drive assembly 18 of any type suitable for advancing the drill string 12 to form the borehole 14 in the earth 20. For example, commercially available boring machines utilize percussive force, continuous thrust and rotary boring type systems. These systems may be powered pneumatically, electrically, hydraulically, or otherwise, depending on the nature of the boring head and the terrain. In that regard, the terms "earth" and "soil," as used herein, encompass any type of soil, such as sand, clay, rock, gravel, and combinations of these.

To stabilize the boring machine at the bore site, the frame 16 of the machine 10 is stabilized by at least one anchor assembly 22 connectable to the frame in a manner to be described. Preferably, the boring machine 10 comprises more than one anchor assembly 22 and more preferably the boring machine comprises four or more anchor assemblies positioned in front of and on both sides of the machine, all of the anchor assemblies being designated by the same reference numeral 22. The number and position of the anchor assemblies 22 will be selected depending on the size of the machine, the drive force being exerted by the machine, the condition of the soil, the resistance between the borehole and the drill string, and other factors.

Figure 2:
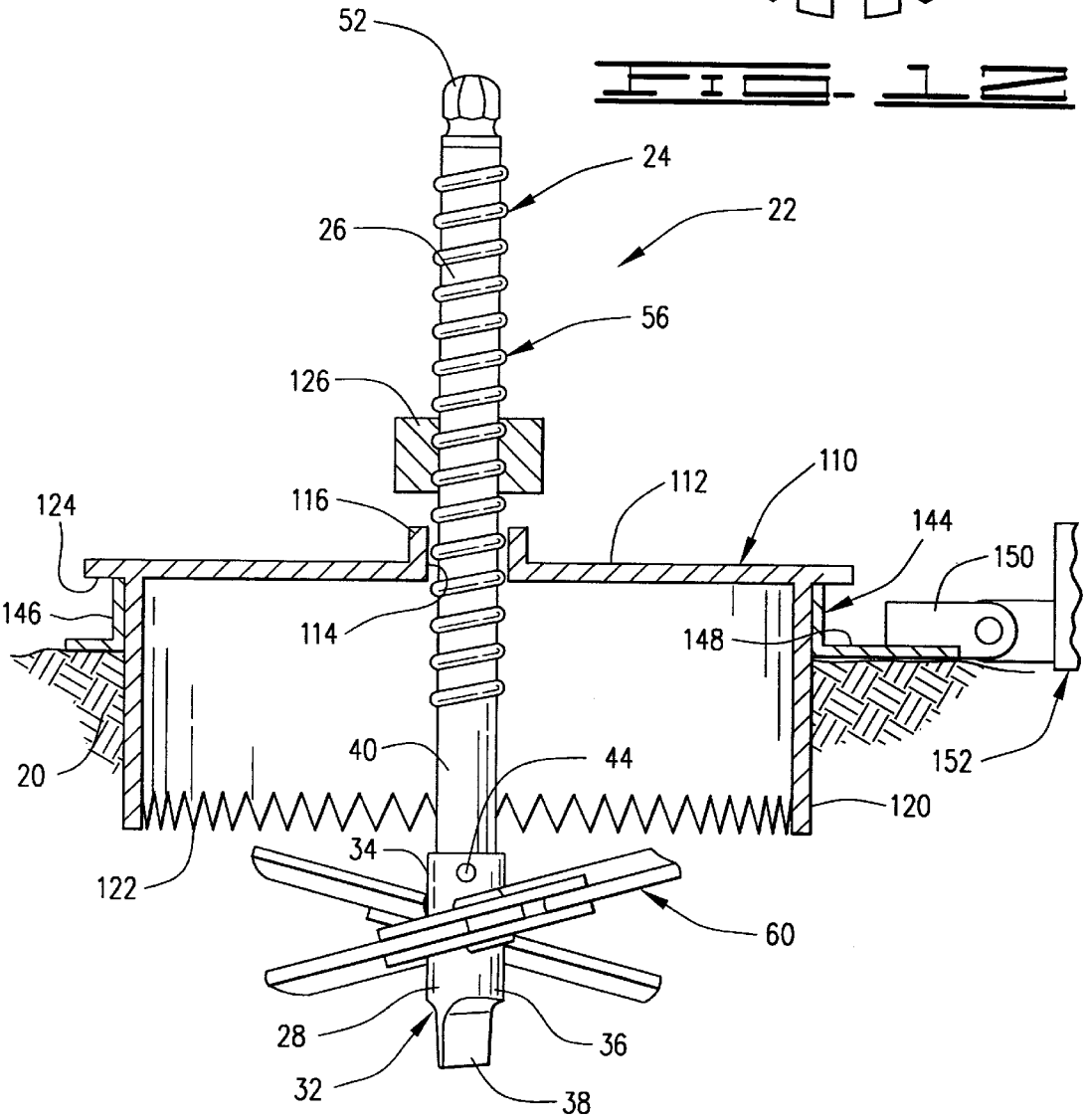
FIG. 2 shows a side elevational, partly sectional view of an anchor assembly partially embedded in the earth.

As all the anchor assemblies are similarly constructed, only one will be described in detail herein. Turning, then, to FIG. 2 the preferred construction of the anchor assembly 22 now will be explained.

The anchor assembly 22 generally comprises a shaft 24 having an upper portion 26 and a lower portion 28. The lower portion 28 is adapted for piercing and screwing into the earth 20, while the upper portion 26 is adapted to connect to the frame 16 of the boring machine 10 and to attach the anchor assembly to a powered rotary motor drive 30 (see FIG. 1), which may or may not comprise part of the boring machine. As the rotary drive is of conventional design, and several suitable types are commercially available, it will not be shown or described in detail.

With continuing reference to FIG. 2, the upper portion 26 of the shaft 24 may be integrally formed with the lower portion 28 or separately made and permanently affixed thereto. Alternatively, and preferably, the lower portion 28 of the shaft 24 may be a separate portion, referred to herein as a hub 32, which is removably connectable to the upper portion 26. This allows interchangeability of parts. In this way, if either the upper portion of the shaft or the hub becomes damaged the undamaged part may be reused. In addition, hubs having different sizes, lengths and helical assemblies (to be described) can be selected according to soil type, machine size, and so forth.

The hub 32 has an upper end 34 and a lower or downhole end 36. The downhole end 36 of the hub 32 (or the lower portion of an integral shaft) preferably is provided with a bit 38. The bit 38 may be a pointed or beveled end integrally formed on the hub 32 or a removable, replaceable bit.

Figure 3:
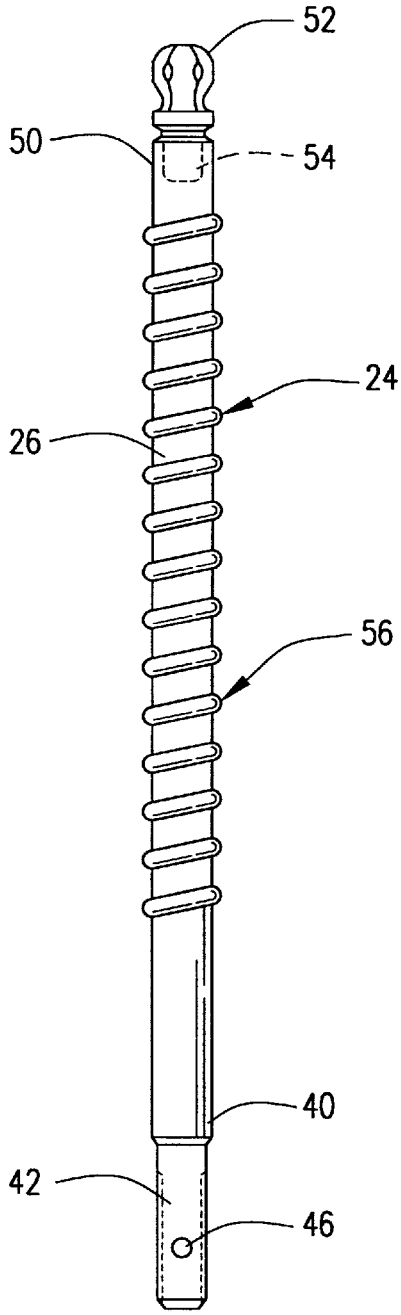
FIG. 3 is a side elevational view of the upper portion of the shaft of the anchor assembly illustrating the hex head removably attached to the upper end.

The upper end 34 of the hub 32 is adapted to removably connect to the lower end 40 of the upper portion 26 of the shaft 24. Referring now also to FIG. 3, the preferred configuration for the shaft 24 is illustrated. The lower end 40 of the shaft 24 is provided with a connecting portion 42 extending therefrom, and the upper end 34 of the hub 32 is shaped to receive the connecting portion 42. In the embodiment shown, the upper end 34 of the hub 32 is tubular and the connecting portion 42 is a tubular member of reduced diameter. The telescopic connection formed thereby is secured in some manner as by a roll pin 44 (FIG. 2) receivable in the cross bore 46 in the connecting portion. It will be appreciated, however, that many different means can be used to connect the hub 32 to the lower portion 40 of the shaft 24, such as friction fit, crimping, ring clamps, set screws and adapters of various configurations.

Figure 5:
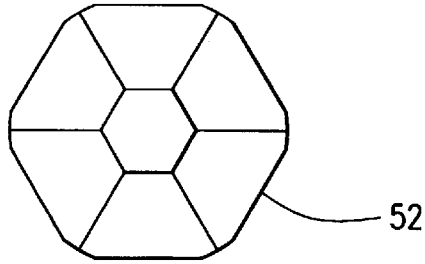
FIG. 5 is an enlarged plan view of the hex head shown in FIG. 3.
Figure 4:
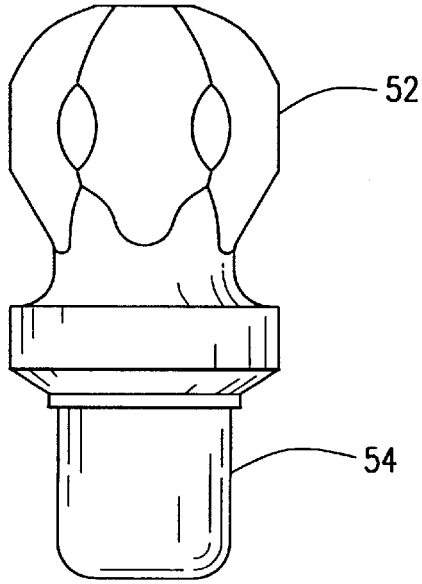
FIG. 4 shows an enlarged side elevational view of the hex head of the shaft shown in FIG. 3.

Referring still to FIG. 3, and also now to FIGS. 4 and 5, the upper end 50 of the shaft 24 is provided with an adapter for connecting the shaft to the rotating drive motor 30 (FIG. 1). The nature of the adapter, of course, will depend on the connection to the motor 30. In the embodiment shown herein, the adapter takes the form of a hexagonal ball adapter 52. The ball adapter 52 is connected to the upper end 50 of the shaft 24 by means of a stopper 54, but any suitable connection may be substituted which will permit rotation from the motor 30 to be transmitted to the shaft 24.

With continuing references to FIG. 3, the upper portion 26 of the shaft 24 is threaded for a reason that will become apparent. The threads 56 may be formed in the shaft by molding, machining or by attaching a separately formed helical member in a known manner.

Attention now is directed to FIGS. 6–9 for a more complete description of the hub 32. The hub 32 is provided with a helical assembly 60 supported thereon. The helical assembly 60 comprises at least one helical flight attached to the hub 32, as by welding or some other manner. Preferably, the helical assembly 60 comprises a plurality of flights, and even more preferably two flights 62 and 64. Now it will be understood that the helical pattern of the flights 62 and 64 renders the shaft 24 insertable into the earth by screwing or rotating the shaft in a first direction and axially advancing the shaft. Likewise, the shaft 24 is thereby rendered removable from the earth by rotating the shaft in second direction opposite the first direction ("counter-rotating") and axially withdrawing the shaft.

With continued reference to FIGS. 6–9, the helical assembly 60 further comprises at least one wing and preferably a plurality of wings. More preferably, the helical assembly 60 comprises two wings 66 and 68, one carried by each of the flights 62 and 64.

Figure 6:
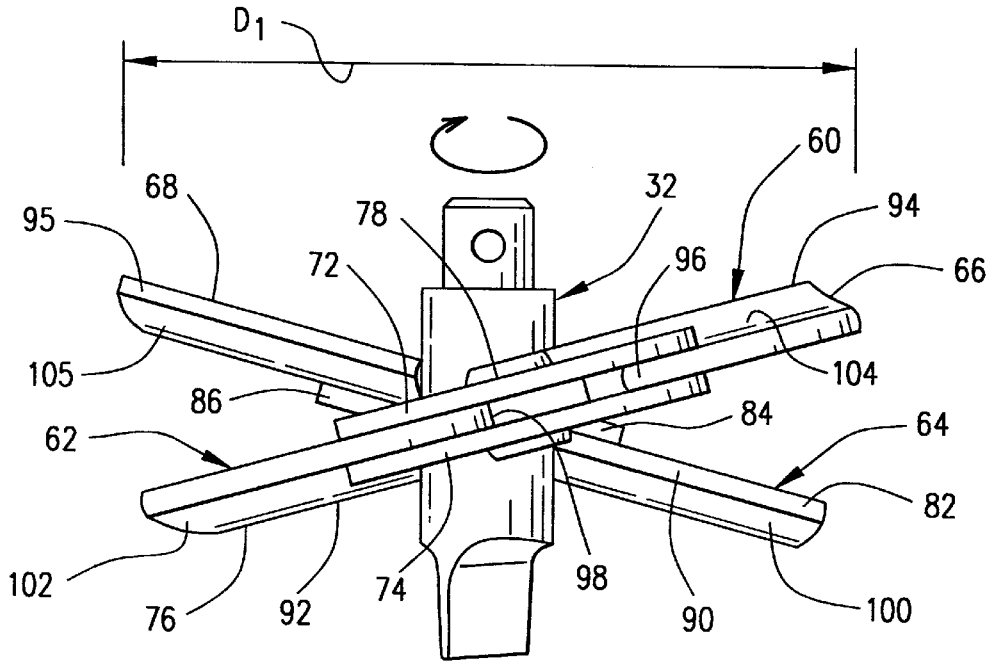
FIG. 6 shows a side elevational view of the hub of the anchor assembly, shown in FIG. 2, illustrating the helical assembly with the wings in the retracted position.
Figure 7:
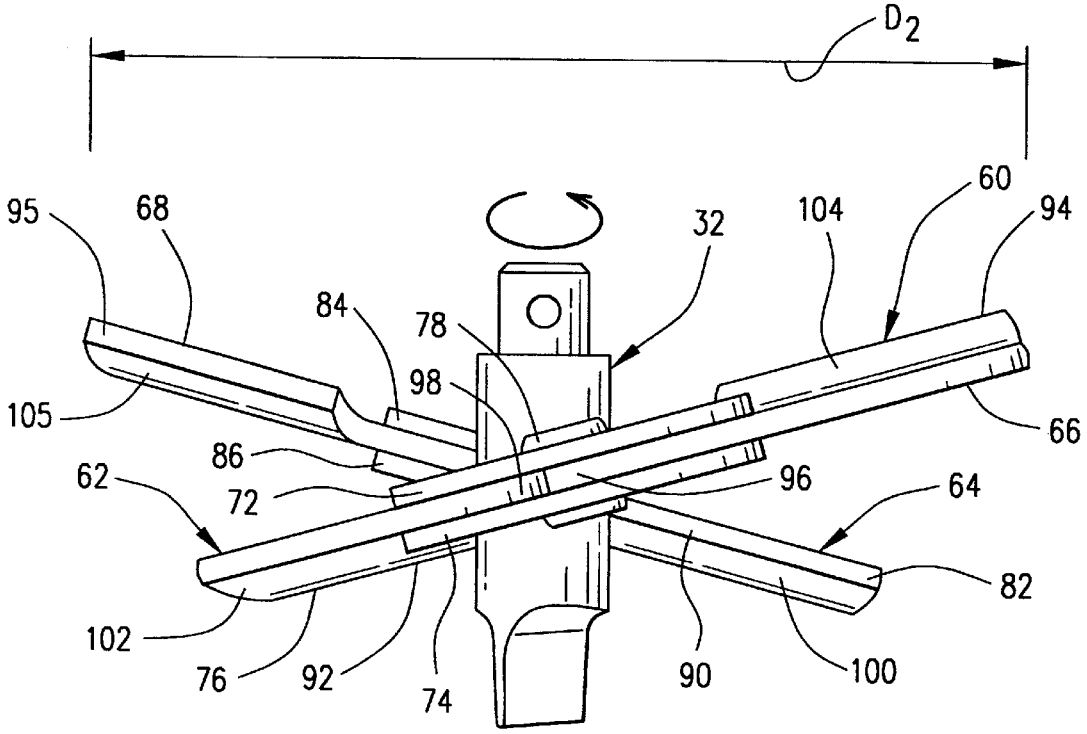
FIG. 7 shows a side elevational view of the hub of FIG. 2 illustrating the wings in the extended position.
Figure 5:
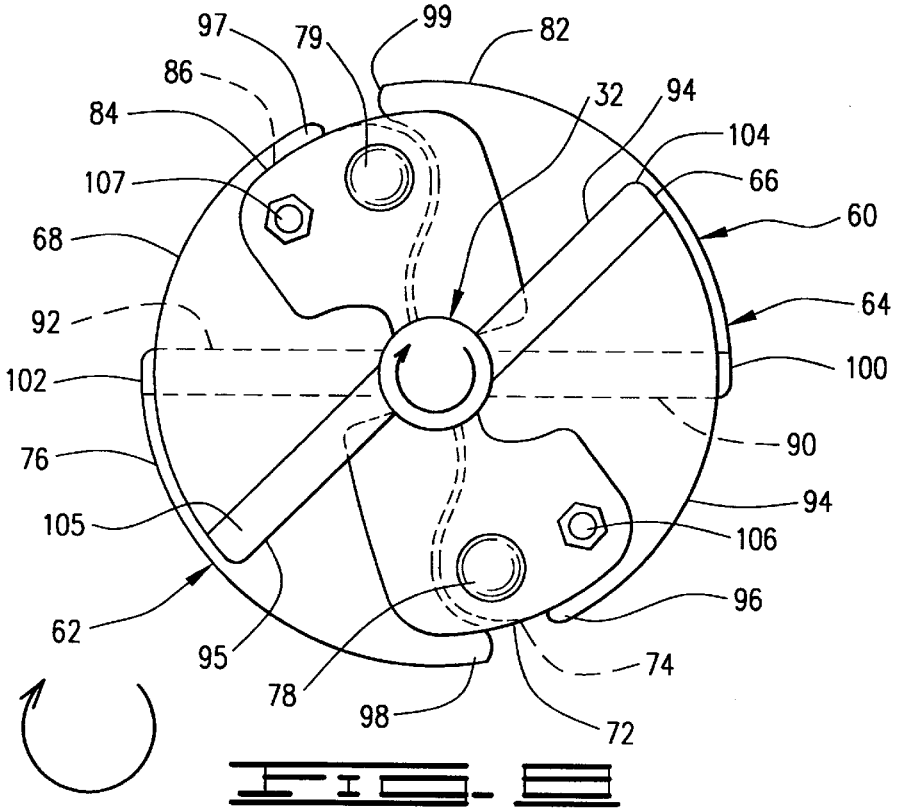
Figure 6:
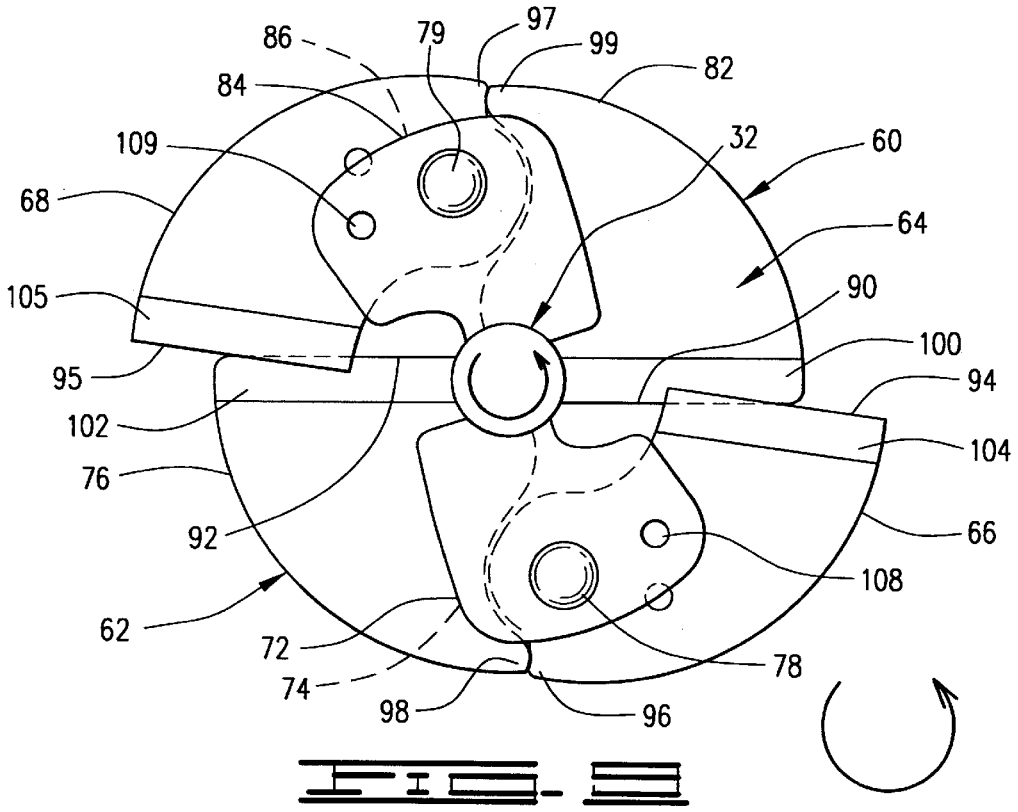

The wings 66 and 68 are supported adjacent the hub 32 and are movable between an extended position and a retracted position. More specifically, the wings are connected in a manner that urges the wings toward the retracted position as the shaft is inserted into the earth, and that urges the wings toward the extended position when the shaft is counter-rotated. FIG. 6 illustrates the retracted position of the wings 66 and 68 and the diameter of the helical assembly is indicated at $D_1$. FIG. 7 illustrates the extended position of the wings 66 and 68 and the expanded diameter of the helical assembly is indicated at $D_2$.

Now it will be appreciated that, as the hub 32 is screwed into the earth, the helical assembly 60 cuts a helical path through the earth of the dimension of $D_1$. However, upon a partial counter-rotation, which forces the wings 66 and 68 into the extended position shown in FIGS. 7 and 9, the extended wings will be cutting a wider helical path into the earth digging into soil not previously disrupted when the shaft was being rotated for insertion.

While many configurations of the wings and flights will accomplish this effect and are within the scope of this invention, one preferred configuration is illustrated. The flight 62 comprises a pair of opposing, parallel upper and lower center plates 72 and 74 and a laterally extending planar side plate 76 partially sandwiched therebetween. The wing 66 is also planar and partially sandwiched between the center plates 72 and 74. However, the wing 66 is pivotally attached by the pin 78. The flight 64 comprises a side plate 82 and upper and lower center plates 84 and 86. In this embodiment the side plates are rigidly fixed to the center plates, and the center plates are rigidly attached to the hub.

Now it will be apparent that as the hub 32 is rotated clockwise, as shown in FIGS. 6 and 8, the edge 90 of the side plate 82 and the edge 92 of the side plate 76 form the leading edges of the helical assembly 60. As shown in FIGS. 7 and 9, as the hub 32 is rotated counter-clockwise, the edge 94 of the wing 66 and the edge 95 of the wing 68 are the leading edges.

Figure 10:
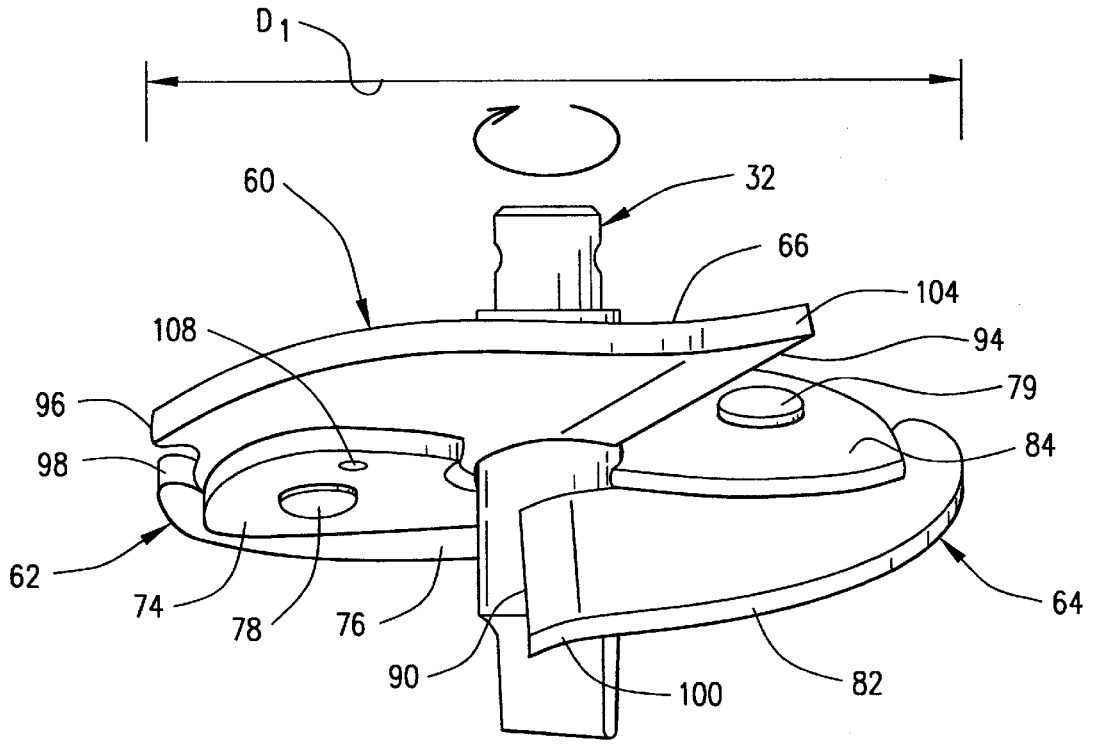
FIG. 10 shows a side perspective view of the hub of FIG. 2 illustrating the helical assembly with the wings in the retracted position.
Figure 11:
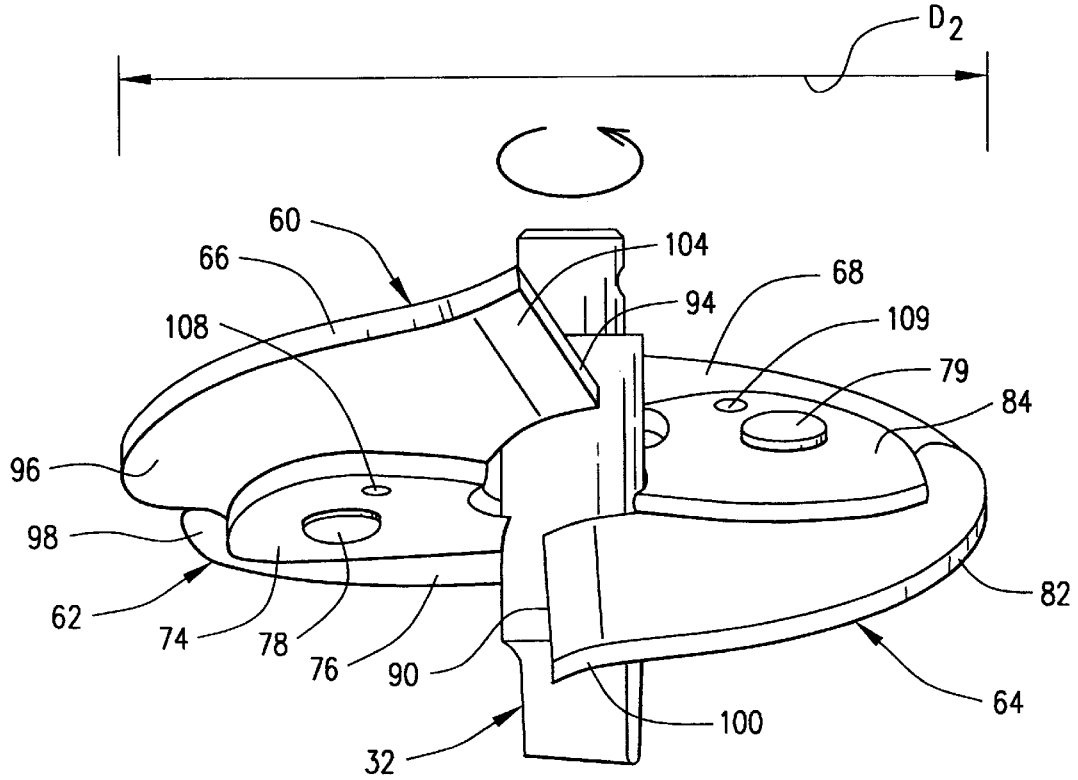
FIG. 11 shows a side perspective view of the hub of FIG. 2 with the wings in the extended position.

Reference now is made also to FIGS. 10 and 11, which show a perspective view of the hub 32 and helical assembly 60 in the retracted and extended positions, respectively. FIGS. 6–11 further illustrate the operation of the helical assembly, as well as the three dimensional configuration of the flights and wings. The side plates 76 and 82 are positioned in the same planes as the wings 66 and 68, respectively. The side plates 76 and 82 and the wings 66 and 68 are contoured to move between the top and bottom plates 72 and 74 and 84 and 86, respectively, so that the wings can pivot around the pins 78 and 79, respectively, in and out of the extended position. Pivotal movement of the wings 66 and 68 may be limited by forming the rear lobes 96 and 97 of the wings to abut the forward corners of the side plates 76 and 82 which serve as stops 98 and 99.

When the hub 32 is rotating during insertion, as illustrated in FIGS. 6, 8 and 10, the edges 90 and 92 of the side plates 76 and 82 are cutting into the soil and the wings 66 and 68 are following. In this direction, the wings 66 and 68 are maintained in the retracted position by the friction of the soil.

On the other hand, when the direction of rotation is reversed, as shown in FIGS. 7, 9 and 11, the edges 94 and 95 begin cutting into soil, including soil undisturbed by the first pass in the opposite direction. The pressure of the soil against the edges 94 and 95 pushes the wings 66 and 68 out into the extended position. Thus, the wings 66 and 68 are expanded by a partial counter-rotation.

As illustrated in FIGS. 6–11, the wings 66 and 68 are helically aligned with the flights 62 and 64 in both the retracted position and in the extended position. As used herein "helically aligned" with reference to the wings denotes a helical pattern compatible with the helical pattern of the flights. Accordingly, the wings may be in the same plane as the flights or parallel thereto, so long as the wings do not interfere substantially with the screwing action imparted by the helical flights.

The leading edges 90 and 92 may be provided with flaps 100 and 102 angled downwardly to aid in directing the helical assembly during insertion. In a like manner, the edges 94 and 95 of the wings 66 and 68 may be provided with flaps 104 and 105 angled upwardly to aid in directing the helical assembly upward during withdrawal.

In some instances, such as where the anchor assembly 22 is being driven into hard or rocky soil, it will be desirable to lock the wings 66 and 68 into the retracted position. For this purpose, the helical assembly 60 may be provided with wing locks. With continued reference to FIGS. 8–11, the preferred wing lock may take the form of bolts 106 and 107 (FIG. 8) receivable in holes 108 and 109 (FIGS. 9–11) in the flights 62 and 64, respectively, and aligned holes (not shown) in the wings 66 and 68, respectively. By inserting the bolts 106 and 107, the wings 66 and 68 are locked into the retracted position. When the bolts 106 and 107 are removed, the wings 66 and 68 function as described previously.

Now it will also be understood that a plurality of boltholes could be provided for locking the wings into different degrees of extension. In this way, the helical assembly could be provided with an adjustable diameter.

Turning once again to FIGS. 1 and 2, the anchor assembly 22 preferably comprises a cap assembly 110. The cap assembly 110 comprises a plate 112 having an aperture 114 (see also FIG. 12) sized to receive the shaft 24. The aperture 114 may be provided with a short neck 116. While the plate 112 is shown as planar, it may be convex or concave, solid or not solid, and may have shapes other than round, such as square or hexagonal.

Figure 12:
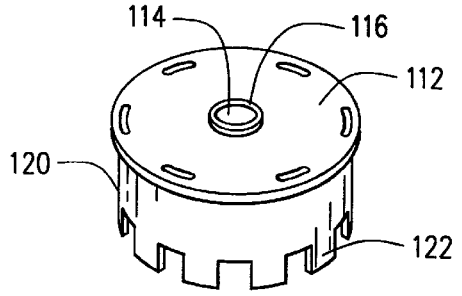
FIG. 12 shows a perspective view of the skirted plate of the cap assembly.

Depending from the plate 112 is an earth engagement member disposed to engage the surface of the earth 20 as the plate is pressed downwardly. Preferably, the earth engagement member takes the form of a cylindrical skirt 120 with a serrated edge 122 for facilitating the penetration of the edge 122 into the soil. The plate 112 preferably has a diameter greater than the diameter of the skirt 120 to provide a peripheral flange 124 that overhangs the skirt. The preferred plate/skirt configuration is better illustrated in FIG. 12. It should be understood, however, that the earth engagement member can take many forms, such as a plurality of depending spikes or prongs, and it may take shapes other than cylindrical. For example, the engagement member could be square or hexagonal. Preferably, though, the plate 112 has generally the same shape as the engagement member. Finally, the serrated edge 122 can take several forms such as pointed, as shown in FIG. 2, or notched, as shown in FIGS. 12 and 13.

Regardless of its form, the relatively large vertical surface of the earth engagement member extends generally perpendicular to the longitudinal axis of the drill string 12 and the pushing and pulling forces on the boring machine 10 during a drilling job. Thus, this vertical surface area provides substantial resistance to the lateral displacement forces acting on the machine and significantly improves the stability of the anchors.

As explained previously, the upper portion 26 of the shaft 24 preferably is provided with threads 56. Now the purpose of this feature will be explained. The cap assembly 110 comprises an anchor lock that is engageable with the upper portion 26 of the shaft 24 to appress the plate 112. A lock nut 126, threadedly receivable on the threads 56 of the shaft 24, is ideal for this purpose. While the lock nut 126 is ideal, other devices may be substituted successfully, such as cam-operated tongs or slips, or vertically adjustable clamps. The preferred configuration for the lock nut is polygonal, and more preferably square, for a reason discussed hereafter.

Figure 13:
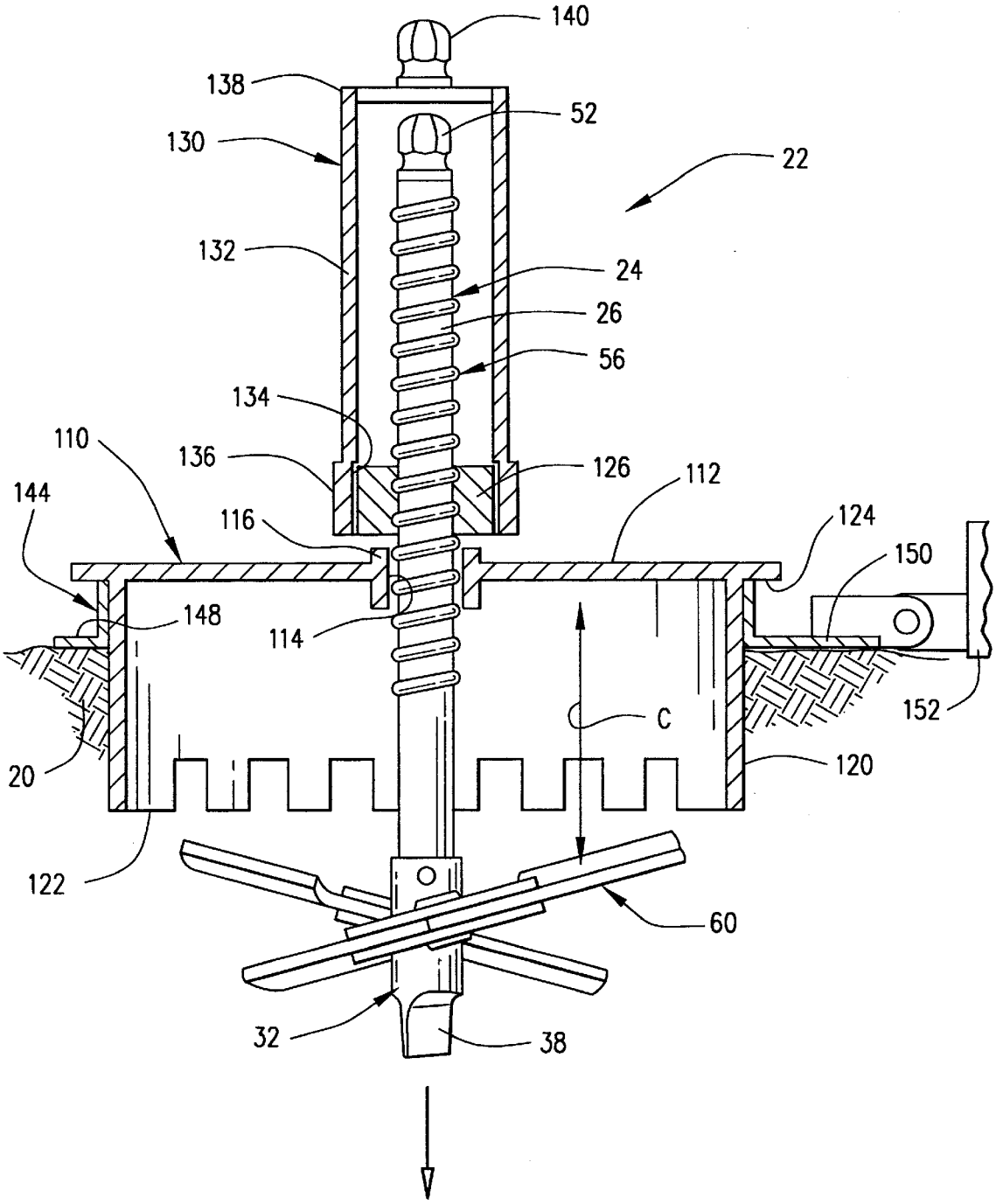
FIG. 13 shows a longitudinal, partially sectional view of the anchor assembly of FIG. 2, showing the nut driving sleeve engaged with the nut to press the cap assembly further into the earth.

A preferred device for threading and tightening the lock nut 126 is illustrated in FIG. 13. The device is a drive connection sleeve 130 preferably comprising a tubular body 132 sized to receive the upper portion 26 of the shaft 24. The lower end 134 of the sleeve 130 is formed into a wrench portion 136 non-rotatingly engageable with the square lock nut 126. The upper end 138 of the sleeve 130 is provided with an adapter by which the sleeve can be connected to a rotary drive motor. Preferably, the adapter is a hexagonal ball 140 similar to the ball adapter 52 on the shaft 24. In this way, the sleeve 130 can be driven by the same motor 30 (see FIG. 1) and connection system used for driving the rotation and counter-rotation of the shaft 24.

Figure 14:
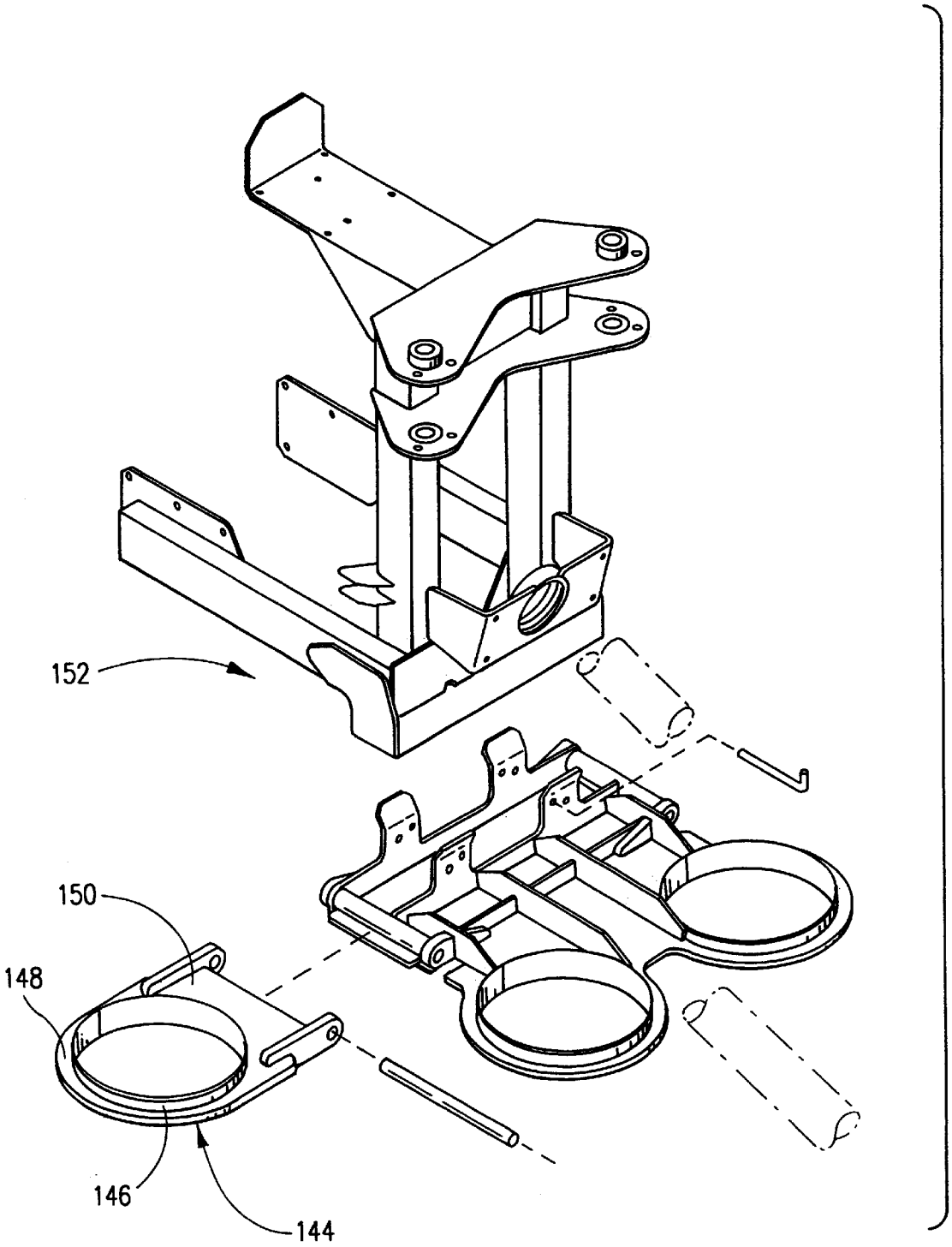
FIG. 14 is an exploded view of the attachment collars and associated bracket assembly by which the anchor assemblies are connected to the boring machine

Turning now to FIG. 14, and with continuing reference to FIGS. 1, 2 and 13, an attachment frame may be used to connect the anchor assembly 22 to the frame 116 of the boring machine 10. While the structure of the attachment frame may take many forms, in the preferred embodiment the attachment frame comprises a collar 144. The collar 144 comprises a cylindrical neck 146 with a peripheral flange 148. The flange 148 provides a broad base to support the collar 144 on the surface of the earth 20. The diameter of the neck 146 preferably is selected to receive the skirt 120 of the cap assembly 110 therethrough. The height of the neck 146 selected to engage the flange 124 of the plate 112 when the lower portion of the skirt 120 is embedded in the soil 20 around the shaft 24.

An extension 150 extends from the collar 144, and preferably from the flange 148, to connect to the frame 16 of the machine 10 in any suitable manner. As explained herein, in most instances two to four anchor assemblies will be used for a single machine. For this reason it is advantageous to provide the machine with a bracket assembly 152 which allows multiple attachment collars to be attached in a selected arrangement, as illustrated in FIG. 14.

In some instances, it may be advantageous to consolidate the functions of the above described cap assembly 110 and the collar 144 by integrating these structures. This may be carried out by providing a cover plate on the top of the neck 146 and a depending skirt extending from the bottom of the flange 148.

Having described the structure of the present invention, the operation will now be explained. As illustrated in FIG. 1, the boring machine 10 is first positioned at a selected site. Next, the number and position of anchor assemblies are determined. Then, the anchor assemblies are installed.

Installation of the anchor assembly begins with the placement of the attachment collar 144. Next, the bit 38 on the hub 32 of the shaft 24 is pointed at the desired insertion point inside the collar 144. Then, the cap assembly 110 is positioned by inserting the shaft 24 through the aperture 114 of the plate 112 and then nesting the skirt 120 inside the neck 146 of the collar 144. The shaft is rotated by connecting the motor 30 to the hex ball 52. The helical assembly 60 screws the shaft into the ground. Once the shaft 24 is embedded to the desired level, the direction of the motor 30 is reversed and the shaft 24 is counter-rotated about one-quarter revolution. This reverse rotation spreads the wings into the extended position, better engaging the helical assembly in the soil.

Having implanted the shaft 24 in the earth, the connection to the motor 30 is removed. The skirt 120 is pressed down into the ground and embedded therein. Next, the hex nut 126 is manually threaded down the upper portion 26 of the shaft 24 until the nut engages the neck 116 of the plate 112.

To tighten the nut 126 against the cap assembly 110, and the plate 112 against the collar 144, the connection sleeve 130 (FIG. 13) is placed over the shaft 24 and positioned so that the wrench portion 136 engages the nut 126. Then, the motor 30 is connected to the hex ball 140 on the upper end 138 of the sleeve 130, and the nut is driven until the plate 112 contacts the top edge of the neck 146 of the collar 144. This inserts the skirt 120 into the earth 20 to provide maximum resistance to lateral movement of the machine 10 on the surface of the earth 20. Further, this compresses the soil 20 between the helical assembly 60 and the cap assembly 110, clamping the soil as illustrated by the bi-directional arrow "C" in FIG. 13.

When the boring operation is completed, the anchor installation process is performed in reverse. Now it will be appreciated that, while the expanded wings embedded in the undisturbed soil resist dislodgement of the anchor during operation of the boring machine, the helical alignment of the wings facilitates the removal of the anchor by counter-rotation.

The anchor assembly of this invention has been described as particularly applicable for use with a horizontal boring machine to stabilize the machine at the bore site. It will be appreciated, however, that the present invention has many other applications and could be utilized to secure any object to any compressible material into which the anchor can be driven. It will therefore be apparent that, as used herein, "compressible material" means any material that is amenable to insertion of a helical member.

Changes may be made in the combination and arrangement of the various parts, elements, steps and procedures described herein without departing from the spirit and scope of the invention as defined in the following claims.

What is claimed is:

1. An anchor assembly for securing an object to a compressible material, comprising:

a shaft having an upper portion and a lower portion; and a helical assembly on the lower portion of the shaft, comprising:

a helical flight disposed at a selected angle relative to a longitudinal axis of the lower portion of the shaft rendering the lower portion of the shaft insertable into the compressible material by rotating the shaft in a first direction and axially advancing the shaft, and removable from the compressible material by rotating the shaft in a second direction opposite the first direction and axially withdrawing the shaft; and a wing supported adjacent the lower portion of the shaft and movable, within a plane that is substantially parallel to the angled disposition of the helical flight relative to the lower portion of the shaft, between an extended position and a retracted position, the wing thereby helically aligned with the helical flight in both the extended position and the retracted position so that as the shaft is inserted into the compressible material the wing is urged toward the retracted position and so that as the shaft is rotated in the second direction the wing is urged toward the extended position thereby expanding the outer diameter of the helical assembly.

2. The anchor assembly of claim 1 wherein the helical assembly comprises a plurality of flights, each flight carrying a wing.

3. The anchor assembly of claim 2 wherein the wings are pivotally connected to the flights.

4. The anchor assembly of claim 3 further comprising a wing lock capable of securing the wings to the flights in a desired position.

5. The anchor assembly of claim 4 wherein each wing and each flight is provided with a plurality of apertures therethrough and wherein the wing lock comprises a bolt and a nut, the bolt disposable through the aperture in the wing and the aperture in the flight and secured therein via the nut.

6. The anchor assembly of claim 1 wherein the wing is lockable in the extended position.

7. The anchor assembly of claim 6 wherein the wing is lockable in at least one position between the extended and the retracted position.

8. The anchor assembly of claim 1 wherein the lower portion of the shaft comprises a hub removably connectable to the upper portion, and wherein the helical assembly is supported on the hub.

9. The anchor assembly of claim 8 wherein the helical assembly comprises a plurality of flights and a plurality of wings, wherein each wing is pivotally attached to one of said flights, and wherein the flights are attached to the hub.

10. The anchor assembly of claim 9 further comprising a wing lock capable of securing the wings to the flights in the desired position.

11. The anchor assembly of claim 10 wherein each wing and each flight is provided with a plurality of aperture therethrough and wherein the wing lock comprises a bolt and a nut, the bolt disposable through the aperture in the wing and the aperture in the flight and secured therein via the nut.

12. The anchor assembly of claim 8 wherein the hub terminates in a downhole end and wherein the downhole end comprises a bit.

13. The anchor assembly of claim 1 wherein the lower portion of the shaft terminates in a downhole end comprising a bit.

14. The anchor assembly of claim 1 further comprising a cap assembly including:

a plate having an aperture sized to receive the upper portion of the shaft;

a material engagement member depending from the plate and disposed to engage the surface of the compressible material; and a lock engageable with the upper portion of the shaft adapted to press the plate toward the lower portion of the shaft whereby when the lower portion of the shaft is embedded in the compressible material the compressible material is compressed between the plate and the helical assembly.

15. The anchor assembly of claim 14 wherein the upper portion of the shaft is threaded and wherein the lock comprises a nut receivable along the threaded upper portion of the shaft.

16. The anchor assembly of claim 15 further comprising a drive connection sleeve sized to be received over the upper portion of the shaft, wherein the nut is polygonally shaped, and wherein the drive connection sleeve comprises a lower end portion non-rotatingly engageable with the nut so that rotation of the sleeve is transmitted to the nut.

17. The anchor assembly of claim 14 wherein the material engagement member comprises a skirt.

18. The anchor assembly of claim 17 wherein a bottom edge of the skirt is serrated whereby penetration of the compressible material is facilitated.

19. The anchor assembly of claim 18 wherein the upper portion of the shaft is threaded and wherein the lock comprises a nut receivable along the threaded upper portion of the shaft.

20. The anchor assembly of claim 17 wherein the skirt is cylindrical.

21. The anchor assembly of claim 20 wherein the plate is circular and has a diameter greater than the skirt to provide a flange extending from a top of the skirt, wherein the anchor assembly further comprises an attachment collar connectable to the object and having a cylindrical neck sized to receive the skirt of the cap assembly and to support the flange of the plate.

22. The anchor assembly of claim 14 further comprising a drive connection member non-rotatably engageable with the lock whereby rotation of the drive connection member is transmitted to the lock.

23. The anchor assembly of claim 14 wherein the anchor assembly further comprises an attachment collar connectable to the object and engageable with the cap assembly.

24. A boring machine for advancing a drill string underground to form a borehole in the earth, the machine comprising:

a frame;

means for advancing the drill string from the frame to form the borehole in the earth;

an anchor assembly connectable to the frame, comprising:

a shaft having an upper portion and a lower portion;

a helical assembly on the lower portion of the shaft, comprising:

a helical flight rendering the lower portion of the shaft insertable into the compressible material by rotating the shaft in a first direction and axially advancing the shaft and removable from the compressible material by rotating the shaft in a second direction opposite from the first direction and axially withdrawing the shaft; and a wing supported adjacent the lower portion of the shaft and movable between an extended position and a retracted position, the wing being helically aligned with the flight in both the extended position and the retracted position so that as the shaft is inserted into the compressible material the wing is urged toward the retracted position and so that as the shaft is withdrawn the wing is urged toward the extended position.

25. The boring machine of claim 24 wherein the helical assembly comprises a plurality of flights, each flight carrying a wing.

26. The boring machine of claim 25 wherein each of the wings is pivotally connected to each of the respective flights.

27. The boring machine of claim 26 further comprising a wing lock capable of securing the wings to the flights in a desired position.

28. The boring machine of claim 27 wherein each wing and each flight is provided with a plurality of apertures therethrough and wherein the wing lock comprises a bolt and a nut, the bolt disposable through the aperture in the wing and the aperture in the flight and secured therein via the nut.

29. The boring machine of claim 24 wherein the wing is lockable in the extended position.

30. The boring machine of claim 29 wherein the wing is lockable in at least one position between the extended and the retracted position.

31. The boring machine of claim 24 wherein the lower portion of the shaft comprises a hub removably connectable to the upper portion, and wherein the helical assembly is supported on the hub.

32. The boring machine of claim 31 wherein the helical assembly comprises a plurality of flights and a plurality of wings, wherein each wing is pivotally attached to a flight, and wherein the flights are attached to the hub.

33. The boring machine of claim 32 further comprising a wing lock capable of securing the wings to the flights in the desired position.

34. The boring machine of claim 33 wherein each wing and each flight is provided with a plurality of aperture therethrough and wherein the wing lock comprises a bolt and a nut, the bolt disposable through the aperture in the wing and the aperture in the flight and secured therein via the nut.

35. The boring machine of claim 31 wherein the hub terminates in a downhole end and wherein the downhole end comprises a bit.

36. The boring machine of claim 24 wherein the lower portion of the shaft terminates in a downhole end comprising a bit.

37. The boring machine of claim 24 wherein the anchor assembly further comprises a cap assembly including:

a plate having an aperture sized to receive the upper portion of the shaft;

an earth engagement member depending from the plate and disposed to engage the surface of the earth when the lower portion of the shaft is embedded in the earth; and an anchor lock engageable with the upper portion of the shaft adapted to press the plate toward the lower portion of the shaft whereby when the anchor assembly is embedded in the earth the earth is compressed between the plate and the helical assembly.

38. The boring machine of claim 37 wherein the upper portion of the shaft of the anchor assembly is threaded and wherein the anchor lock comprises a nut receivable along the threaded upper portion of the shaft.

39. The boring machine of claim 38 further comprising a drive connection sleeve sized to be received over the upper portion of the shaft, wherein the nut is polygonally shaped, and wherein the drive connection sleeve comprises a lower end portion non-rotatingly engageable with the nut so that rotation of the sleeve is transmitted to the nut.

40. The boring machine of claim 37 wherein the earth engagement member comprises a skirt.

41. The boring machine of claim 40 wherein the bottom edge of the skirt is serrated whereby penetration of the earth is facilitated.

42. The boring machine of claim 41 wherein the upper portion of the shaft is threaded and wherein the anchor lock comprises a nut receivable along the threaded upper portion of the shaft.

43. The boring machine of claim 40 wherein the skirt is cylindrical.

44. The boring machine of claim 43 wherein the plate is circular and has a diameter greater than the skirt to provide a flange extending from the top of the skirt, wherein the anchor assembly further comprises an attachment collar connectable to the object and having a cylindrical neck sized to receive the skirt of the cap assembly and to support the flange of the plate.

45. The boring machine of claim 37 further comprising a drive connection member non-rotatably engageable with the anchor lock whereby rotation of the drive connection member is transmitted to the lock.

46. The boring machine of claim 37 wherein the anchor assembly further comprises an attachment collar connectable to the frame of the boring machine and engageable with the cap assembly.

47. The boring machine of claim 24 further comprising a plurality of anchor assemblies.

* * * * *